United States Patent [19]

Pozzobon

[11] Patent Number: 4,923,207

[45] Date of Patent: May 8, 1990

[54] MIDDLE BINDING PARTICULARLY FOR SKI SHOES

[75] Inventor: Alessandro Pozzobon, Paderno di Ponzano Veneto, Italy

[73] Assignee: Nordica S.p.A., Montebelluna, Italy

[21] Appl. No.: 148,198

[22] Filed: Jan. 27, 1988

Related U.S. Application Data

[62] Division of Ser. No. 897,563, Aug. 18, 1986, abandoned.

[30] Foreign Application Priority Data

Sep. 4, 1985 [IT] Italy ..... 22065 A/85

[51] Int. Cl.[5] ..... A63C 9/08

[52] U.S. Cl. ..... 280/613; 280/605; 280/634

[58] Field of Search ..... 280/605, 613, 616, 623, 280/624, 627, 633, 634

[56] References Cited

U.S. PATENT DOCUMENTS

| | | | |
|---|---|---|---|
| 3,061,325 | 10/1962 | Glass | 280/613 |
| 3,869,136 | 3/1975 | Jackson | 280/613 |
| 3,931,982 | 1/1976 | Kubelka | 280/613 |
| 3,936,062 | 2/1976 | Schweizer | 280/613 |
| 3,992,037 | 11/1976 | Fréchin | 280/613 |
| 4,063,752 | 12/1977 | Whitaker et al. | 280/624 |
| 4,087,113 | 5/1978 | Riedel | 280/605 |
| 4,145,071 | 3/1979 | Salomon | 280/624 |

FOREIGN PATENT DOCUMENTS

| | | | |
|---|---|---|---|
| 211410 | 7/1909 | Fed. Rep. of Germany | 280/11.32 |
| 1801192 | 10/1968 | Fed. Rep. of Germany | 280/613 |
| 2028996 | 10/1971 | Fed. Rep. of Germany | 280/613 |

*Primary Examiner*—Charles A. Marmor
*Assistant Examiner*—Brian L. Johnson
*Attorney, Agent, or Firm*—Guido Modiano; Albert Josif

[57] ABSTRACT

This middle binding particularly for ski shoes comprises a box-type case attachable to a ski and supporting a forward hook-on ferrule and a rear hook-on ferrule removably engageable in hook-on seats correspondingly defined in the sole of a ski shoe. The binding further comprises screw members for adjusting the release tension and hook elements or jaws for removably locking the ferrules in a retracted position. The hook elements or jaws are disengaged by actuators protruding from the box-type case and engaged by the ski shoe sole.

6 Claims, 2 Drawing Sheets

MIDDLE BINDING PARTICULARLY FOR SKI SHOES

This is a division of Ser. No. 06/897,563 filed Aug. 18, 1986, now abandoned.

BACKGROUND OF THE INVENTION

This invention relates to a middle binding particularly for ski shoes, specifically of the hidden type.

As is known currently available on the market are hidden middle bindings for ski shoes or boots which are set up to effect hooking of the ski shoe on the ski by engagement in a recess defined in the sole of the ski shoe.

With conventional bindings it occurs that, to carry out the coupling between the shoe and ski, it is necessary to exert a pressure action such as to overcome the elastic bias of the forward and rear ferrules provided in the binding, to bring them to snap into the seats specially pre-arranged in the recess.

This procedure creates, in many cases, considerable coupling difficulty, and it is not infrequent to fail to obtain accurate positioning between the binding and the shoe.

Another drawback affecting known solutions is that considerable difficulty and structural complications are encountered in carrying out adjustment of the binding release tension and, moreover, known solutions afford no adjustment of the rear ferrule and forward ferrule where the adjustments act independently of each other.

SUMMARY OF THE INVENTION

Therefore it is the aim of this invention to remove the prior drawbacks by providing a novel middle binding of the hidden type which is specially designed for ski shoes and enables actuation of the coupling between the shoe and ski without the necessity to exert efforts, but by merely inserting the binding into the seat, and only after the binding is positioned in the seat provided in the footwear sole, to obtain the desired coupling.

It is a particular object of the invention to provide a middle binding which affords mutually independent adjustment of the forward ferrule and rear ferrule, thus favoring a more effective adjustment of the binding.

Also an object of this invention is to provide a middle binding which has a highly compact conformation so as to affect a limited region of the ski, thereby it does not reduce or in any way change the elastic characteristics of the ski.

Another object of this invention is to provide a middle binding which is structurally simple and fully reliable and safe in use.

The above outlined aim, and these and other objects to become apparent hereinafter, are achieved by a middle binding particularly for ski shoes, according to the invention, comprising a box-type case attachable to a ski and supporting a forward hook-on ferrule and a rear hook-on ferrule removably engageable with hook-on seats correspondingly defined in a sole of a ski shoe, there being also provided means of adjusting the release tension, characterized in that it comprises means for removably locking said ferrules at a retracted position driven by actuators actuatable by said sole.

BRIEF DESCRIPTION OF THE DRAWINGS

Further features and advantages will be apparent from the description of some preferred, but not exclusive, embodiments of a middle binding particularly for ski shoes, as shown by way of illustration and not of limitation in the accompanying drawings, where.

DESCRIPTION OF THE PREFERRED EMBODIMENTS

Figure 1:
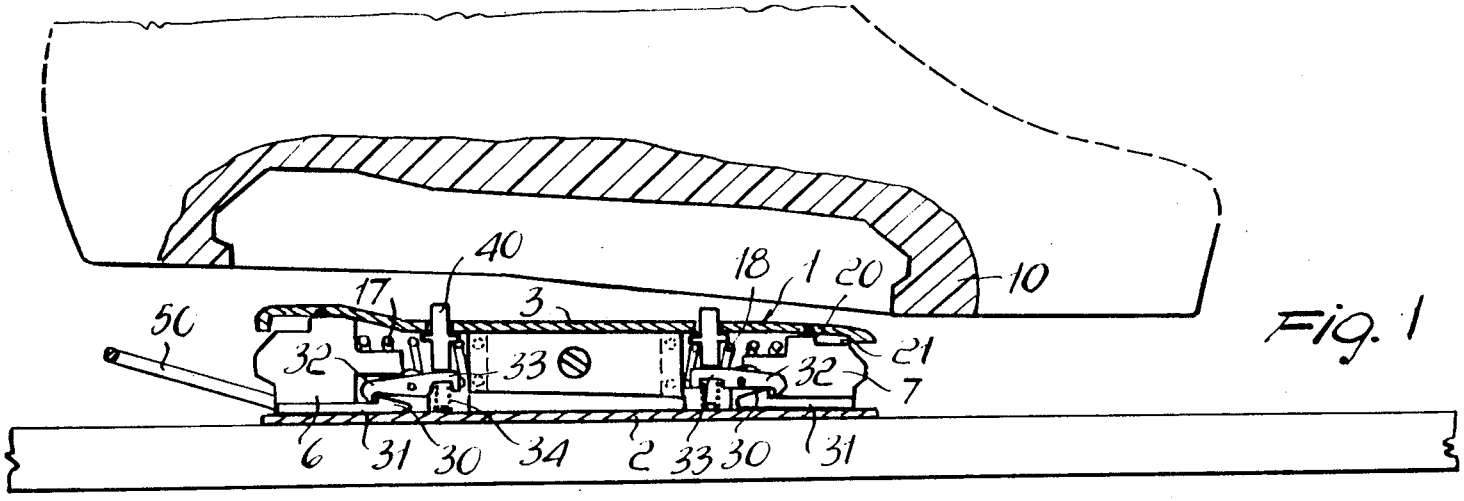
FIG. 1 shows diagrammatically and in longitudinal section the binding as set up for coupling to the shoe with the ferrules in their re-entered position.
Figure 2:
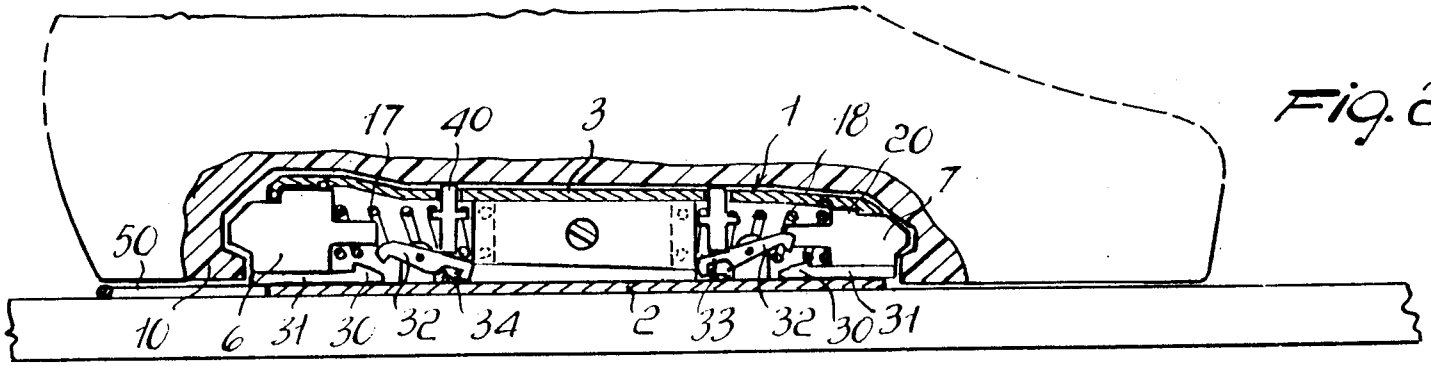
FIG. 2 shows diagrammatically in longitudinal section the binding according to this invention.
Figure 3:
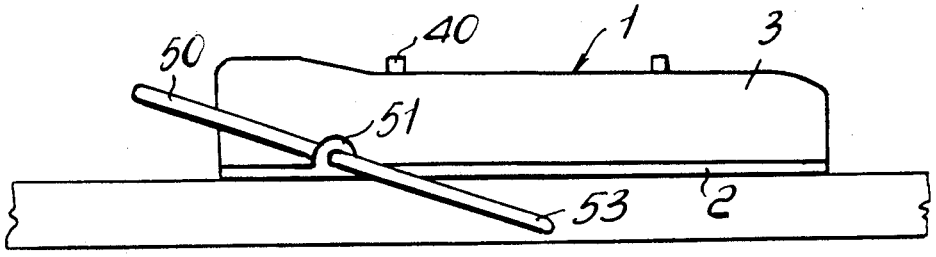
FIG. 3 shows the binding in side elevation with ski stop.
Figure 4:
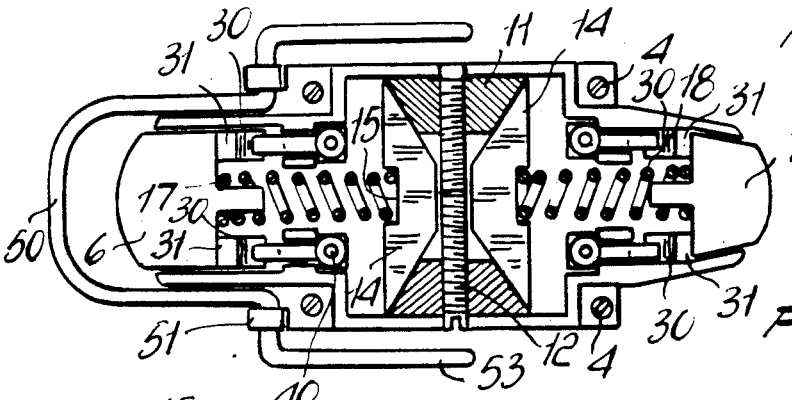
FIG. 4 shows diagrammatically in plan and partially cut-away view the binding according to this invention.

With reference to the cited drawing figures and in particular to FIGS. 1 to 4, there is shown a hidden type middle binding which comprises a box-type case, designated generally with the reference numeral 1, comprising a support plate 2 and a cover element 3 coupled thereto, defining the accommodation for the elements making up the binding.

The plate 2 is provided, at its corners, with throughholes for accommodating screws 4 for fastening to the ski.

As may be readily appreciated, the length dimension of the binding is extremely reduced thereby the binding itself does not affect the elastic and flexible characteristics of the ski.

Supported inside the box-type case 1 for sliding movement are a forward ferrule 7 and a rear ferrule 6 which may engage in corresponding hook-on seats defined in a recess provided in the sole of the ski boot, generally designated with the reference numeral 10.

The binding further comprises means for adjusting the release tension which, in the embodiment described in FIGS. 1 to 4, includes substantially a pair of juxtaposed double wedges 11 engaging with a double-threaded bar 12 arranged crosswise to the longitudinal extent of the binding so as to create symmetrical translation of the double wedges 11 on rotating the threaded crossbar 12.

The double wedges 11 act on actuating wedges 14 defining each a seat 15 for abutment respectively of a rear bias spring 17 and a forward bias spring 18 which act with an elastic thrust action against the ferrules 6 and 7 to hold them elastically in the extraction position.

The ferrules 6 and 7 have a ledge element 20 which engages with a corresponding stop 21 defined by the cover element so as to prevent their slipping off the box-type case.

Adjustment of the double wedges 11 causes translation in the longitudinal direction of the actuating wedges 14 with consequent different compressive action exerted on the springs 17 and 18 and thus change in the action of elastic bias exerted on the ferrules, whereas elastic bias action corresponds in practice to the release tension.

An important feature of the invention is the provision of means for removably locking the ferrules 6 and 7 in a retracted position, thereby it is extremely easy to insert them into the recess defined in the sole 10, having then a successive automatic withdrawal of the ferrules to move into the locked position.

Said removably locking means comprises in this specific case a pair of hooks 30 provided on lugs 31 extending from the ferrules 6 and 7 inwardly and engaging with the hook-on section of a pawl element 32 swingable mounted on the plate 2 and having the end 33 remote from the hook-on section acting against a thrust spring 34.

The removably locking means further comprises actuators consisting of stems 40 acting on the end 33 and emerging upwardly from the box-type case 1. The stems 40 may be depressed by the sole to obtain release of the hook 30 from the pawl element 32 with consequent elastic exiting of the ferrules 6 and 7 and their engagement within the seats defined in the recess provided in the sole 10.

In actual use, the skier, when he wants to hook on the boot or shoe, having previously positioned the ferrules 6 and 7 in the retracted position, is simply to bring the sole over the binding introducing the box-type case 1 into the recess provided in the sole itself and then by exerting a pressure action he pushes the actuators 40 which carry out automatic locking of the binding to the sole as a consequence of the disengagement of the removable locking means.

Furthermore the binding is provided with a ski stop, which comprises an oscillating lever 50 journalled in small ears 51 defined by the box-type case 1 and having a rear portion pressable by the sole to bring the lever 50 in a horizontal position and a forward introduction portion 53 which tends to penetrate the snow, when the rear portion is not depressed.

Figure 5:
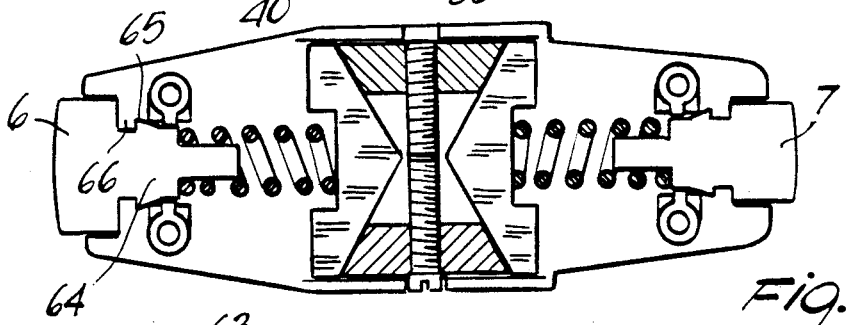
FIG. 5 shows in plan view the binding with a different embodiment of the means for locking the ferrules in a re-entered position.
Figure 6:
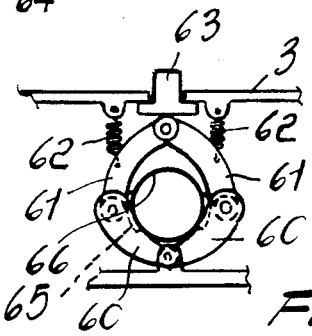
FIGS. 6 and 7 show diagrammatically and in front elevation two different embodiments of the means for locking the ferrules in the oriented position.
Figure 7:
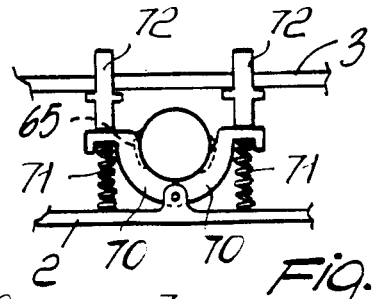

Two different embodiments of the means for removable locking the ferrules, again indicated at 6 and 7, in the retracted position are shown in FIGS. 5 to 7.

The embodiment shown in FIG. 6 has a pair of small lower connecting rods 60 journalled together and connected to the lower portion of the box-type case 1 at one end thereof and articulated, at the other end thereof, to a pair of small upper connecting rods 61. According to FIG. 6, tension springs 62 are connected to the inner upper portion of the cover element 3 of the box-type case 1 and act on the upper connecting rods 61, whereas an actuator consisting of a pushbutton 63 acts at the mutual hinge connection between the small connecting rods 61.

The connecting rods 60 and 61 practically define an expandable articulated mechanism which encircle a tang portion 64 extending inwardly from the ferrules and defining teeth 65 which delimit a locking groove 66.

In the retracted position of the ferrules the small connecting rods, pulled by the action of the tension springs 62, are housed in the groove 66.

On exerting a pressure action on the pushbutton 63 the small connecting rods 60 and 61 tend to spread apart and come out of the groove, allowing outwardly movement of the ferrules.

Similar in conception is the embodiment shown in FIG. 7 where there are provided lower jaw elements 70, journalled together and connected at the mutual pivot point to the plate 2 of the box-type case 1; thrust springs 71 provided between the upper free ends of the jaws 70 and the plate 2 act on the lower faces of these ends whilst actuators comprising small pegs 72 protruding from the cover portion of the case act on the upper face thereof.

Also with this embodiment it occurs that, with the small pegs 72 in the extracted position, the thurst springs 71 can keep the jaw elements 70 within the groove 66 thus effecting locking by engagement with the teeth 65.

A pressure action exerted on the small pegs 72 causes spreading of the jaws 70 with consequent disengagement thereof from the groove 66 and outward movement of the ferrules as urged by their thrust springs 17 and 18.

Figure 8:
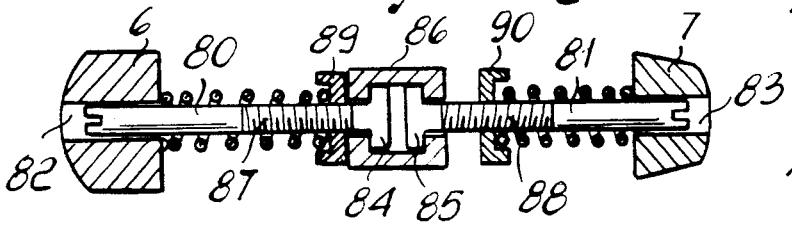
FIG. 8 shows diagrammatically a different embodiment of the means of adjusting the release tension.

With reference to FIG. 8, an embodiment is diagrammatically shown wherein it is possible to effect adjustment of the forward ferrule, again indicated at 7, and the rear ferrule, again indicated at 6, independently. As in the embodiments according to FIGS. 1–7, the ferrules are provided with a removable locking means of the type previously described and not shown in FIG. 8.

The means of adjusting the release tension comprises a forward stem 81 and a rear stem 80 which are accessible from central channels 82 and 83 respectively defined by the ferrules 6 and 7.

At their inner end the stems 80 and 81 have a widened portion 84 and 85, respectively, which is rotatably accommodated in a middle block 86.

The middle stems have each threaded portion 87 and 88, respectively, engaging washers 89 and 90 which are prevented from turning through a guide, for example, defined by the box-type case 1.

Thus on rotating the stems 80 or 81 the washer 89 or the washer 90 are caused to translate independently to each other with consequent change in the adjustment of the forward spring 17 or of the rear spring 18, and possibility of independently effecting adjustment of the release tension of the forward and rear ferrules.

This embodiment, in addition to affording an adjustment system for the hook-up or release tension obtained independently for the forward and rear ferrules, also affords containment of the binding transverse dimensions.

Thus, the binding housing seat to be made in the sole of the boot affords improved continuity of the sole structure, ensuring the required rigidity for obtaining a good binding.

In actual use, to effect hooking of the binding on the boot, it will be sufficient, with the forward and rear ferrules in the retracted position, to arrange the shoe sole over the binding and exert a slight downward pressure which allows depression of the actuators, which automatically cause the outward movement of the ferrules with their engagement in the related hook-up seats.

To effect release, conventional lever means are utilized which are not described herein in detail.

It may be seen from the foregoing description that the binding according to the invention achieves the objects set forth and in particular that it has an extremely compact conformation with considerable advantages both constructional and practical in nature, because it requires no particular actions or efforts to carry out the coupling between the binding and the sole.

Another important aspect is then represented by the possibility of independently adjusting the release tension for the forward and the rear ferrules.

The invention herein is susceptible to many modifications and changes within the scope of the inventive concept.

Furthermore, all the details may be replaced with other technically equivalent elements.

In practicing the invention, the materials used, so long as compatible with the specific use, as well as the dimensions and contingent shapes may be any ones depending on necessity.

I claim:

1. A middle ski binding, particularly for use with ski shoes comprising a sole having a bottom surface with a middle recess formed inwardly thereof, said ski binding comprising:

an elongate box-type case attachable to a ski and including an upper cover element, a lower support plate, a forward end and a rear end;

a forward hook-on ferrule mounted in said box-type case at said forward end thereof;

a rear hook-on ferrule mounted in said box-type case at said rear end thereof;

said forward and said rear ferrules being arranged for reciprocating sliding movement longitudinally of said box-type case between an inoperative retracted position and an operative extended position;

a forward hook-on seat and a rearward hook-on seat defined in said sole recess for removably engaging said respective forward and rear hook-on ferrules in said operative extended position;

first spring means located internally of said box-type case and operative on said forward and said rearward hook-on ferrules to normally urge them in said operative extended position to thereby resiliently engage said respective hook-on seats;

means for adjusting the release tension exerted by said first spring means on said respective forward and rearward hook-on ferrules;

wherein said ski binding further comprises releasable locking means for releasably locking said forward and rear ferrules in said inoperative retracted position, said locking means comprising at least one grooved element defined on each of said forward and rear ferrules, a releasable mechanism engageable with said grooved element to lock said forward and rear ferrules in said retracted position, second spring means operative on said releasable mechanism to hold said mechanism in stable engagement with said grooved element, actuating means located partially internally of said box-type case and interacting with said releasable mechanism for disengagement thereof from said grooved element, said actuating means projecting at least partially outwardly of said box-type case to be automatically operated by insertion of said said box-type case in said recessed sole, whereby said forward and said rear ferrules are initially locked in their retracted position to thereby enable easy insertion of said box-type case in said recessed sole, whereupon said actuating means are concurrently operated so as to automatically release said forward and rear hook-on ferrules from said retracted position to allow said ferrules to move outwardly towards their operative extended position for engagement with said respective hook-on seats.

2. A middle ski binding, particularly for use with ski shoes comprising a sole having a bottom surface with a middle recess formed inwardly thereof, said ski binding comprising:

an elongate box-type case attachable to a ski and including an upper cover element, a lower support plate, a forward end and a rear end;

a forward hook-on ferrule mounted in said box-type case at said forward end thereof;

a rear hook-on ferrule mounted in said box-type case at said rear end thereof;

said forward and said rear ferrules being arranged for reciprocating sliding movement longitudinally of said box-type case between an inoperative retracted position and an operative extended position;

a forward hook-on seat and a rearward hook-on seat defined in said sole recess for removably engaging said respective forward and rear hook-on ferrules in said operative extended position;

first spring means located internally of said box-type case and operative on said forward and said rearward hook-on ferrules to normally urge them in said operative extended position to thereby resiliently engage said respective hook-on seats;

means for adjusting the release tension exerted by said first spring means on said respective forward and rearward hook-on ferrules;

wherein said ski binding further comprises releasable locking means for releasably locking said forward and rear ferrules in said inoperative retracted position, said locking means comprising at least one grooved element defined on each of said forward and rear ferrules, a releasable mechanism engageable with said grooved element to lock said forward and rear ferrules in said retracted position, second spring means operative on said releasable mechanism to hold said mechanism in stable engagement with said grooved element, actuating means located partially internally of said box-type case and interacting with said releasable mechanism for disengagement thereof from said grooved element, said actuating means projecting at least partially outwardly of said box-type case to be automatically operated by insertion of said said box-type case in said recessed sole, whereby said forward and said rear ferrules are initially locked in their retracted position to thereby enable easy insertion of said box-type case in said recessed sole, whereupon said actuating means are concurrently operated so as to automatically release said forward and rear hook-on ferrules from said retracted position to allow said ferrules to move outwardly towards their operative extended position for engagement with said respective hook-on seats, wherein said forward and said rear ferrules have a substantially elongate body of reduced diameter defining an inwardly extending tapered tang-like portion, said grooved element comprising tooth formations extending laterally of said elongate body and defining a transversely extending groove adjacent to said tang-like portion.

3. A middle ski binding according to claim 2, wherein said releasable mechanism comprises an expandable, articulated structure of substantially annular configuration encircling said tang-like body portion, said articulated structure including a pair of upper connecting rods and a pair of lower connecting rods, said upper and said lower connecting rods extending in a substantially vertical plane and being mutually articulated at adjacent ends thereof, said lower connecting rods having lower ends journalled to said lower support plate of said box-type case, said upper connecting rods having upper mutually hinged ends, said second spring means including a pair of tension springs located between said upper cover element of said box-type case and said upper connecting rods and being operative to force said articulated structure to at least partially engage with said transversely extending groove, said upper cover plate of said box-type case having a through aperture overlaying said locking mechanism, said actuating means comprising a push-button element guided for vertical movement in said through aperture, said push button element having an upper portion projecting upwardly of said upper cover element and a bottom surface engaging said upper mutually hinged ends of said upper connecting rods, whereby depression of said top portion of said push button element by insertion of said box-type case in said sole recess, causes said articulated structure to expand to thereby disengage from said transversely extending groove.

4. A middle ski binding particularly for use with ski shoes comprising a sole having a bottom surface with a middle recess formed inwardly thereof, said ski binding comprising:

an elongate box-type case attachable to a ski and including an upper cover element, a lower support plate, a forward end and a rear end;

a forward hook-on ferrule mounted in said box-type case at said forward end thereof;

a rear hook-on ferrule mounted in said box-type case at said rear end thereof;

said forward and said rear ferrules being arranged for reciprocating sliding movement longitudinally of said box-type case between an inoperative retracted position and an operative extended position;

a forward hook-on seat and a rearward hook-on seat defined in said sole recess for removably engaging said respective forward and rear hook-on ferrules in said operative extended position;

first spring means located internally of said box-type case and operative on said forward and said rearward hook-on ferrules to normally urge them in said operative extended position to thereby resiliently engage said respective hook-on seats;

means for adjusting the release tension exerted by said first spring means on said respective forward and rearward hook-on ferrules;

wherein said ski binding further comprises releasable locking means for releasably locking said forward and rear ferrules in said inoperative retracted position, said locking means comprising at least one grooved element defined on each of said forward and rear ferrules, a releasable mechanism engageable with said grooved element to lock said forward and rear ferrules in said retracted position, second spring means operative on said releasable mechanism to hold said mechanism in stable engagement with said grooved element, actuating means located partially internally of said box-type case and interacting with said releasable mechanism for disengagement thereof from said grooved element, said actuating means projecting at least partially outwardly of said box-type case to be automatically operated by insertion of said said box-type case in said recessed sole, whereby said forward and said rear ferrules are initially locked in their retracted position to thereby enable easy insertion of said box-type case in said recessed sole, whereupon said actuating means are concurrently operated so as to automatically release said forward and rear hook-on ferrules from said retracted position to allow said ferrules to move outwardly towards their operative extended position for engagement with said respective hook-on seats, wherein said forward and said rear ferrules have a substantially elongate body of reduced diameter defining an inwardly extending tapered tang-like portion, said grooved element comprising tooth formations extending laterally of said elongate body and defining a transversely extending groove adjacent to said tang-like portion, wherein said releasable mechanism comprises a pair of jaw elements at least partially encircling said tang-like body portion underneath thereof, said jaw elements extending obliquely in a substantially vertical plane and having lower ends journalled to said lower support plate and upper free ends, said upper free ends defining upper end surfaces and lower end surfaces, said second spring means comprising a pair of compression springs extending between said lower end surfaces and said lower support plate of said box-type case, said compression spring being operative to force said jaw elements to engage said transversely extending groove, said upper cover element having a pair of through apertures overlaying said upper end surfaces of said jaws elements, said actuating means comprising a pair of pegs slidably guided in said through apertures, said pegs having top portions projecting upwardly of said upper cover element and bottom portions engaging with said upper end surfaces of said jaw elements, whereby depression of said pegs by insertion of said box-type case into said recessed sole causes said jaws element to spread apart to disengage from said transversely extending groove.

5. A concealed ski binding arrangement adapted for use with ski shoes of the type comprising a sole having a bottom surface with a middle recess formed inwardly thereof, said ski binding comprising an elongate box-type case attached to a ski and including an upper cover element, a lower support plate, a forward end and a rear end, said ski binding further comprising a forward and a rear hook-on ferrules mounted in said box-type case respectively at said forward and rear ends thereof for longitudinal movement between an inoperative retracted position and an operative extended position, a forward and a rear hook-on seats defined in said sole recess for removably engaging said respective forward and rear hook-on ferrules when they are in said operative extended position, first spring means located internally of said box-type case and urging said forward and said rear hook-on ferrules towards said operative extended position, tension adjustment means for adjusting the release tension exerted by said first spring means on said respective forward and rearward hook-on ferrules, wherein said ski binding further comprises a releasable locking mechanism for releasably locking said forward and rear ferrules in said inoperative retracted position, said forward and said rear hook-on ferrule each comprising an inwardly extending tapered tang-like portion with an adjacent transversely extending groove, said locking mechanism comprising a pair of upper connecting rods and a pair of lower connecting rods mutually hinged at adjacent ends thereof, said lower connecting rods having lower ends journalled to said lower support plate of said box-type case, said upper connecting rods having upper mutually hinged ends, said upper and said lower connecting rods defining altogether an annular articulated structure encircling said tang-like body portion, said second spring means including a pair of tension springs located between said upper cover element of said box-type case and said upper connecting rods and being operative to force said annular articulated structure to at least partially engage with said transversly extending groove, said upper cover element of said box-type case having a through aperture overlaying said upper and lower connecting rods, said ski binding further comprising actuating means interacting with said releasable locking mechanism for disengagement thereof from said transversely extending groove, said actuating means comprising a push-buttom element guided for vertical movement in said through aperture, said push button element having an upper portion projecting upwardly of said upper cover element and a bottom surface engaging said upper mutually hinged ends of said upper connecting rods.

6. A concealed ski binding arrangement adapted for use with ski shoes of the type comprising a sole having a bottom surface with a middle recess formed inwardly thereof, said ski binding comprising an elongate box-type case attached to a ski and including an upper cover element, a lower support plate, a forward end and a rear end, said ski binding further comprising a forward and a rear hook-on ferrules mounted in said box-type case respectively at said forward and said rear end thereof for longitudinal movement between an inoperative retracted position and an operative extended position, a forward and a rear hook-on seats defined in said middle sole recess for removably engaging said respective forward and rear hook-on ferrules when they are in said operative extended position, first spring means located internally of said box-type case and urging said forward and said rear hook-on ferrules towards said operative extended position, tension adjustment means for adjusting the release tension exerted by said first spring means on said respective forward and rearward hook-on ferrules, wherein said ski binding further comprises a releasable locking mechanism for releasably locking said forward and rear ferrules in said inoperative retracted position, said forward and said rear hook-on ferrule each comprising an inwardly extending tapered tang-like portion with an adjacent transversely extending groove, said locking mechanism comprising a pair of jaw elements extending below said tang-like body portion and at least partially encircling it, said jaw elements having first lower ends which are unitary hingedly connected to said lower support plate of said box-type case and second upper free ends, said upper free ends having substantially planar upper end surfaces and substantially planar lower end surfaces, said second spring means comprising a pair of compression springs interposed between said lower end surfaces and said lower support plate of said box-type case, said compression springs acting upwardly on said jaw elements to locate them inside said tranversely extending groove, said upper cover element having a pair of through apertures superposed to said upper end surfaces of said jaws elements, said ski binding further comprising actuating means interacting with said releasable locking mechanism for disengagement thereof from said transversely extending groove, said actuating means comprising a pair of pegs slidably guided in said through apertures, said pegs having top portions projecting upwardly of said upper cover element and bottom portions acting on said upper end surfaces of said jaw elements.

* * * * *